US009890956B1

(12) United States Patent
McCue

(10) Patent No.: US 9,890,956 B1
(45) Date of Patent: Feb. 13, 2018

(54) DEVICE FOR ASH REMOVAL

(76) Inventor: Michael McCue, Westlake, OH (US)

( * ) Notice: Subject to any disclaimer, the term of this patent is extended or adjusted under 35 U.S.C. 154(b) by 23 days.

(21) Appl. No.: 12/762,868

(22) Filed: Apr. 19, 2010

(51) Int. Cl.
*F24B 15/00* (2006.01)

(52) U.S. Cl.
CPC ..... *F24B 15/007* (2013.01)

(58) Field of Classification Search
CPC ... E01H 1/1206; A01K 23/005; A01K 1/0114; F23J 1/04; A01B 1/02; F24B 15/10; F24B 13/008; F24B 15/04; F24B 15/08; A47L 13/52; B65F 1/163; B65D 17/161; B03B 9/04; B07B 1/02
USPC ..... 294/1.3–1.5, 9, 176, 10; 126/242–244, 126/245; 15/257.1, 257.6, 257.7; 220/2, 220/263, 268; 209/233, 235, 417, 419
See application file for complete search history.

(56) References Cited

U.S. PATENT DOCUMENTS

| | | | | | |
|---|---|---|---|---|---|
| 46,946 | A | * | 3/1865 | Schaap | 209/419 |
| 159,667 | A | * | 2/1875 | Goodfellow | 209/377 |
| 228,749 | A | * | 6/1880 | Fink | 209/376 |
| 306,822 | A | * | 10/1884 | Fritzinger | 209/376 |
| 331,322 | A | * | 12/1885 | Phelps | 209/377 |
| 332,527 | A | * | 12/1885 | Hofer et al. | 126/243 |
| 400,120 | A | * | 3/1889 | Sayer | 209/377 |
| 507,826 | A | * | 10/1893 | Miller | 294/177 |
| 784,562 | A | * | 3/1905 | Hetland | 294/51 |
| 879,622 | A | * | 2/1908 | Galvin | 126/242 |
| 995,913 | A | * | 6/1911 | Samuelson et al. | 126/244 |
| 1,107,066 | A | * | 8/1914 | Heim | 220/501 |
| 1,121,093 | A | * | 12/1914 | Harvey | 15/257.6 |
| 1,470,205 | A | * | 10/1923 | Vogt | 220/263 |
| 1,477,930 | A | * | 12/1923 | Bartholomew et al. | 126/243 |
| 1,847,476 | A | * | 3/1932 | Fuhr | 15/257.1 |
| 4,214,784 | A | | 7/1980 | Rogalski | |
| 4,299,419 | A | | 11/1981 | Kalan | |
| 4,307,704 | A | | 12/1981 | Wagg | |
| 4,334,517 | A | * | 6/1982 | Sweitzer | 126/522 |
| 4,361,245 | A | | 11/1982 | Allen et al. | |
| 4,381,761 | A | | 5/1983 | Foxen | |
| 4,402,538 | A | | 9/1983 | Tyndall | |
| 4,416,252 | A | | 11/1983 | Blank, Jr. | |
| 4,457,548 | A | | 7/1984 | Robins et al. | |
| 4,536,023 | A | | 8/1985 | Sutter | |
| 4,572,560 | A | | 2/1986 | Grandlouis | |
| 4,619,474 | A | | 10/1986 | Dauphinais | |
| 4,659,123 | A | | 4/1987 | Mortensen | |
| 4,700,978 | A | | 10/1987 | Saum | |
| 4,747,178 | A | | 5/1988 | Breitbach | |
| 4,943,002 | A | | 7/1990 | Fraher | |

(Continued)

OTHER PUBLICATIONS

Webster's New Dictionary, Third College Edition Copyright 1988 by Simon & Schuster, Inc.*

*Primary Examiner* — Stephen A Vu
(74) *Attorney, Agent, or Firm* — Curatolo Sidoti Co., LPA; Joseph G. Curatolo; Salvatore A. Sidoti

(57) ABSTRACT

An ash remover for removing ashes from a wood burning stove or fireplace includes a housing with top and bottom walls, spaced-apart side walls, a rear wall, and a front door. A fixed gripping handle projects outwardly from the rear wall of the housing. A pivotable gripping handle is mounted to the side walls of the housing of the ash remover. The ash remover may be used in combination with a sifting tool to separate burning embers from ashes prior to removing the ashes from the wood burning stove or fireplace.

22 Claims, 3 Drawing Sheets

(56) References Cited

U.S. PATENT DOCUMENTS

| | | | | |
|---|---|---|---|---|
| 5,513,883 | A | 5/1996 | Segla | |
| 6,237,973 | B1 | 5/2001 | Dupont et al. | |
| 6,659,285 | B1 * | 12/2003 | Dixon | 209/235 |
| 7,380,848 | B2 * | 6/2008 | Petruzelli | 294/54.5 |

* cited by examiner

DEVICE FOR ASH REMOVAL

TECHNICAL FIELD

The present disclosure relates to a device for removing ashes from a wood burning stove, heater, furnace, or the like. The present disclosure more particularly relates to a device for removing ash from a wood burning stove, heater, furnace, or the like, and transporting the ashes to a remote location.

BACKGROUND

Many people use wood burning heaters, stoves, or fireplaces for heating homes. In those applications in which the stove or fireplace is used for heating, wood is burned on a substantially continuous basis. Therefore, in these applications it is often necessary to remove ashes from the wood burner while the burner is still operating.

The most generally used methods of ash removal from wood burning stoves include the use of a small shovel and dumping ashes into receptacle. This method of transferring ashes and debris into a bucket from the wood burner results in ashes falling on the floor and causing a mess or a fire hazard. Furthermore, the airborne dust from transferring the ashes can be a health hazard to those people who may suffer from asthma, emphysema, or other respiratory ailments.

Therefore, what is needed in the art is a convenient tool for removing hot ashes from a wood burner that avoids the mess of the prior art methods and minimizes the fire hazard traditionally associated with removing ashes from an indoor wood burning device.

SUMMARY

Provided is an ash remover, comprising a housing, a first handle fixedly mounted outwardly from a rear wall of said housing, and a second handle pivotably mounted on the side walls of said housing.

Additionally provided is a kit for separating larger hot coals from the used ash within a wood burning stove and removing the used ash from the wood burning stove, the kit comprising a sifting tool and an ash remover. According to certain illustrative embodiments of the kit, the sifting tool comprises a rake and side fins used to manipulate the used ashes into a pile and a screen attached to an elongated handle, and the ash remover comprises a housing, a first handle fixedly mounted outwardly from a rear wall of said housing, and a second handle pivotably mounted on the side walls of said housing.

DETAILED DESCRIPTION

Figure 1:
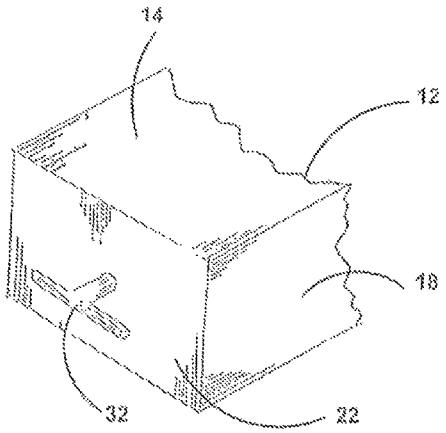
FIG. 1 is a rear perspective fragmentary view of an illustrative embodiment of the ash removing device.

Disclosed is a device for removing ashes from a wood burning stove or fireplace and transporting the ashes to a remote location. The ash removing device comprises a housing. The housing is a box-like housing including top and bottom walls, side walls, a rear wall, and a front door. The front door is hingedly attached to the top wall of the housing. The walls of the box-like housing define an inner volume for accepting ashes and storing the ashes during transport to a location that is remote from the wood burning stove or fireplace from which they were removed.

The ash removing device further includes a first handle that projects outwardly from the rear wall of the housing. According to certain embodiments, the first fixedly mounted handle may be provided as a substantially T-shaped handle portion. The T-shaped handle represents merely one possible geometry of the first fixedly mounted handle of the ash removing device. It should be noted that the first fixedly mounted handle may be provided in any shape that is suitable for gripping with a human hand and allows the ash removing device to be pushed into a wood burning stove, heater, furnace, or the like to remove ashes, and pulled from the wood burning stove, heater, or furnace after the ashes have been captured by the ash removing device.

The ash removing device also includes a second handle that is mounted on the housing. The second handle is pivotably mounted on at least one of the side walls of the housing. According to certain embodiments, the pivotably mounted handle is mounted to both of the side walls of the housing. The second handle of the ash removing device is pivotably mounted outwardly from the side walls of the housing. The second pivotably mounted handle is mounted to the housing in a manner such that the handle is free to pivot from the front of the housing through the neutral position (ie, perpendicular to the top and bottom walls of the housing) at the approximately the mid-section of the housing and to the rear of the housing. The second pivotably mounted handle may be gripped by a user and moved to a position that is outwardly rearwardly from the top surface of the housing of the ash remover to assist the user in moving the front portion of the of housing of the ash remover into a wood burning stove, heater, or the like, allowing both hands to keep from entering the hot stove, and drawing the ash remover from the wood burning stove after a desired amount of ashes have been captured by the ash remover.

According to certain illustrative embodiments, the second pivotably mounted handle is substantially U-shaped. The U-shaped handle includes spaced apart, substantially parallel arms. A bridging or connecting portion extends between the spaced-apart arms of the U-shaped handle. Ends of the spaced-apart arms include bend or flange portions that pivotably connect the arms of the second handle to the side walls of the housing of the device at pivot points. The flanges of the arms also provide clearance between the arms of the second handle and the outer surfaces of the side walls of the housing.

According to certain embodiments, the bridging portion of the second handle may also provide a gripping portion for the user. It should be noted that the second handle may be provided in any shape that is suitable from gripping with a human hand and allows the ash removing device to be pushed into a wood burning stove, heater, furnace, or the like to remove ashes, and to pull the ash removing device from the wood burning stove, heater, or furnace after the ashes have been captured by the ash removing device.

After the ash remover has captured a desired amount of ashes from the wood burning stove the ash remover is drawn out of the stove. According to certain embodiments, the user maintains his or her grip on the first fixedly mounted handle and momentarily releases his or her grip from the pivotably mounted handle. A portion of the bottom wall of the housing rests on the opening of the stove. The user moves the front door of the housing from the open position to the closed position, wherein the front door rests against the front edges of the bottom and side walls of the housing. Once the front door has been closed, then the user grabs the pivotably mounted handle. The user moves the pivotably mounted handle forward and the force of gravity causes the housing to rotate about an imaginary axis that extends between pivot points located on the side walls of the housing. This rotation causes the rear portion of the housing to drop toward the ground. The second pivotably mounted handle of the ash removing device is now in a position projecting outwardly from the front door of the housing of the ash removing device. The length of the arms of the second pivotably mounted handle have sufficient length so that is extends beyond the front door of the housing of the ash remover. Because the second handle extends beyond the front door of the housing, the user is able to safely grip the second handle without the fear of being burned by the housing of the device during removal or transport.

The housing of the device may further include a closure member that is mounted on the outer face of the top wall, or on one of the side walls, so as to releasably close the outside of the housing front door. Alternatively, the housing of the device may include a closure member that is mounted on the outer surface of the front door of the housing of the device.

Additionally provided is a kit that includes a tool for gathering and sifting ashes in a wood burning stove or heater and an ash remover for removing ashes from the wood burning stove. The sifting tool includes a rake and side fins used to manipulate the ashes into a pile and a screen or mesh having an open porosity that may be used to sift through the ashes within a wood burning stove to separate the ashes from burning coals, embers, and the like. The screen of the sifting tool includes a porosity that is large enough to permit ash to pass through the screen, but which is small enough to retain larger coals, embers and wood pieces. The screen is surrounded by a frame that provides a rake and side plates. The frame is connected to an elongated handle having a sufficient length to permit a user to insert the screen portion of the sifting tool into the wood burning stove to sift through the ashes without risking burning injury of the user. The sifting tool may be manufactured from any material that can survive exposure to fire and the high temperature of a wood burning stove.

An illustrative embodiment of the ash removing device will now be described in greater detail with reference to the FIGURES. It should be noted that the ash removing device is not intended to be limited to the illustrative embodiments shown in the FIGURES, but shall include all variations and modifications within the scope of the claims.

FIG. 1 is fragmentary rear perspective view of the ash removing device 10. This view of the device 10 shows the rear portion of the housing 12. Housing includes top wall 14, side wall 18 (opposite side wall is not shown in FIG. 1) and rear wall 22. Extending rearwardly from rear wall 22 is fixed handle 32. Fixed handle is shown having a substantially "T" shape. It should be known, however, that this is merely one illustrative shape for fixed handle 32 and any suitable shape that is grippable may be used.

Figure 2:
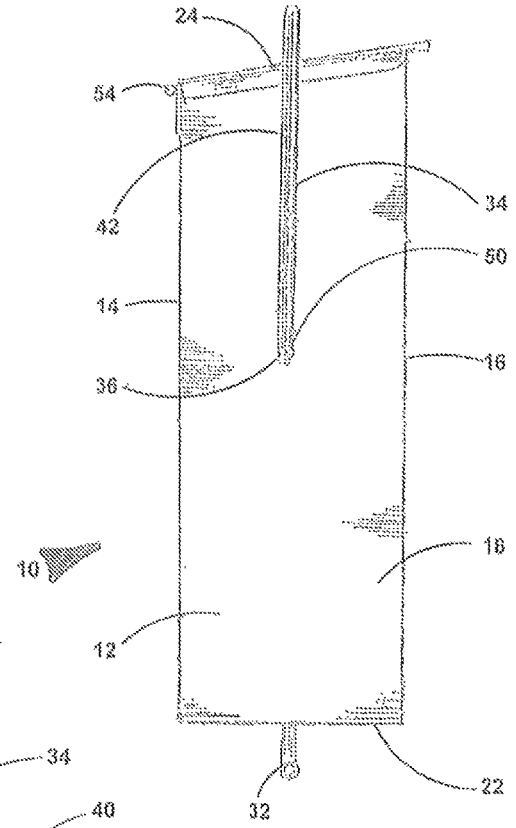
FIG. 2 is a side view of the illustrative embodiment of the ash removing device of FIG. 1.

FIG. 2 shows a side view of ash removing device 10. Device 10 includes housing 12. Housing 12 comprises top wall 14, bottom wall 16, and side walls 18, 20 (side wall 20 not shown). Housing 12 also includes rear wall 22 and front door 24. The front door 24 is hingedly attached by a hinge to the front edge of the top wall 14 of the housing 12 by a hinge member 54. The front edge of the bottom wall 16 extends beyond the front edge of the top wall 14 of the housing 12. The front edges of side walls 18, 20 are sloped. First fixed handle 32 is shown projecting outwardly beyond the rear wall 22 of the housing 12. Second pivotable handle 34 is connected to side wall 18 of housing 12 at pivot point 36. Second pivotable handle 34 is shown in a forward position with a portion of handle 34 extending beyond front wall 24 of the housing 12 of the device 10. In this position, handle 34 is disposed substantially parallel to the spaced-apart top wall 14 and bottom wall 16. FIG. 2 illustrates the ash removing device 10 having a front door 24 of the housing 12 resting against the front sloped edges of side walls 18, 20 in the closed position.

Figure 3:
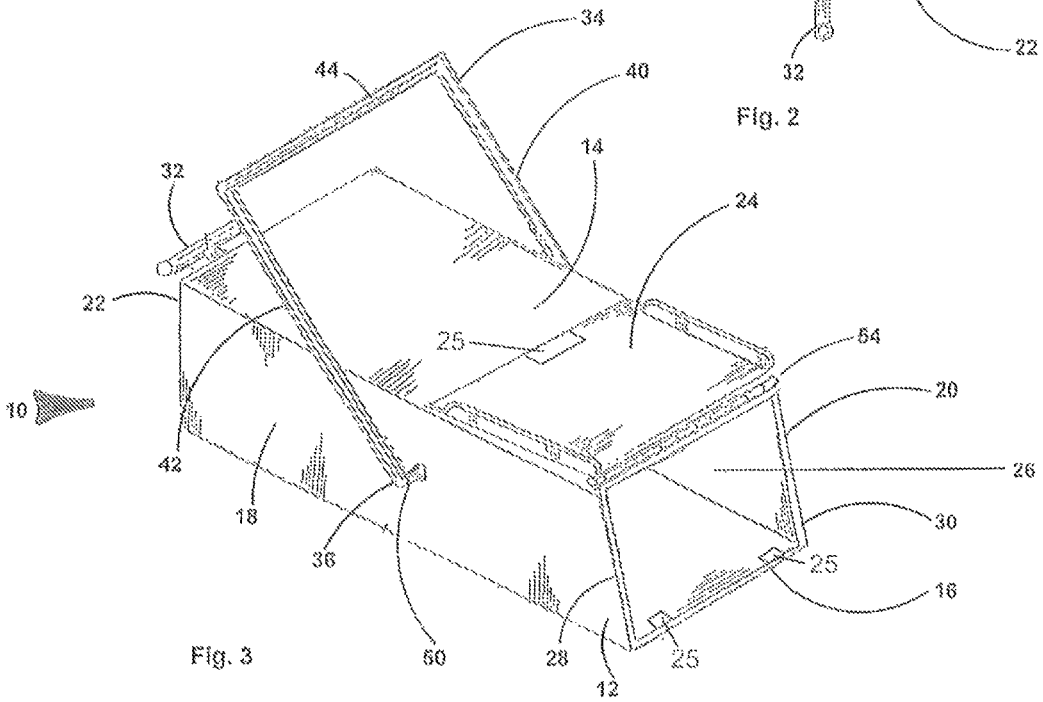
FIG. 3 is a perspective view of the illustrative embodiment of the ash removing device of FIGS. 1 and 2.

FIG. 3 shows a perspective view of ash removing device 10. Device 10 includes housing 12. Housing 12 comprises top wall 14, bottom wall 16, and side walls 18, 20. Housing 12 also includes rear wall 22 and front door 24. The front door 24 is hingedly attached to the front edge of the top wall 14 of the housing 12 by a hinge member 54. The front edge of the bottom wall 16 extends beyond the front edge of the top wall 14 of the housing 12. The front edges of side walls 18, 20 include sloped or otherwise angled front edges 28, 30. According to certain embodiments, a closure member 25 may be mounted on the outer surface of said bottom wall of the housing. According to other embodiments, a closure member 25 mounted on the outer surface of said front door of the housing. First fixed handle 32 is shown projecting outwardly from the rear wall 22 of the housing 12. Arm 42 of second pivotable handle 34 is connected to side wall 18 of housing 12 at pivot point 36 with connecting member 50. Arm 40 of second pivotable handle 34 is connected to side wall 20 of housing 12. Bridging portion 44 extends between arms 40, 42 of handle 34. Second pivotable handle 34 is shown in an upwardly and rearwardly pointing position. The top wall 14, bottom wall 16, side walls 18, 20, rear wall 22 and front door 24 collectively define an inner volume 26 for collecting ashes from a wood burning stove or fireplace. FIG. 3 illustrates the ash removing device 10 having the first surface of front door 24 resting against the top wall 14 of the housing 12 in an open position.

Figure 4:
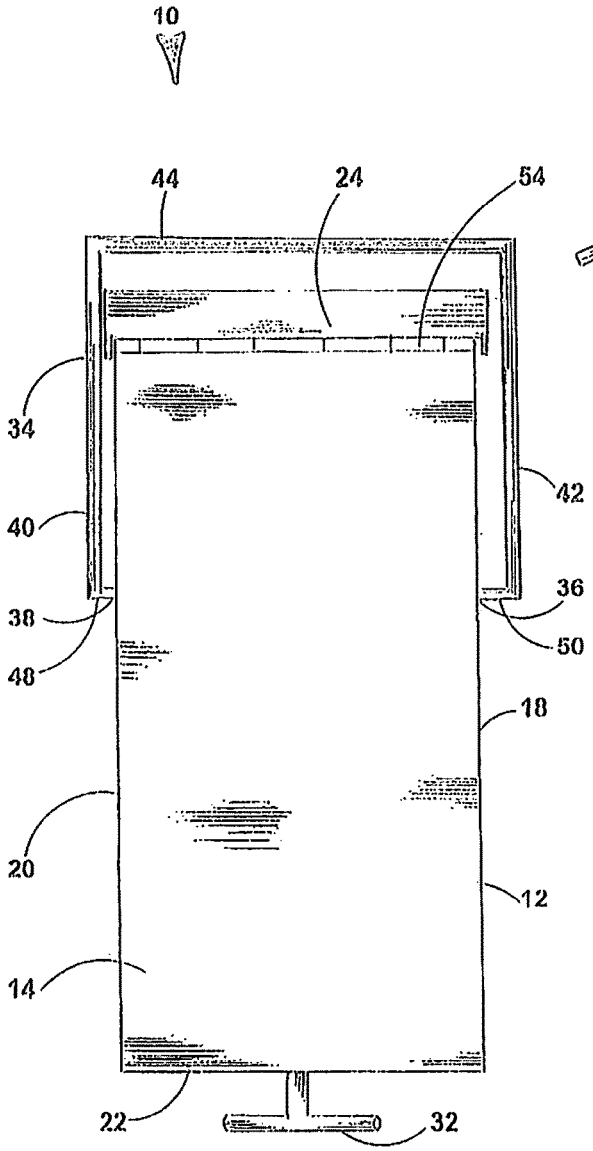
FIG. 4 shows a top view of the illustrative embodiment of the ash removing device of FIGS. 1 and 2.

FIG. 4 is a top view of an illustrative embodiment of the ash removing device 10. Ash removing device 10 comprises an elongated box-like housing 12. The housing 12 comprises top wall 14, bottom wall 16 (not shown in FIG. 4), spaced-apart side walls 18, 20 and spaced-apart rear wall 22 and front door 24. The top wall 14, bottom wall 16, side walls 18, 20, rear wall 22 and front door 24 collectively define an inner volume for accepting ashes from a wood burning stove or fireplace.

Still referring to FIG. 4 a first handle 32 is mounted or otherwise secured to the rear wall 22 of the housing 12 of the ash removing device 10. The first handle 32 is fixedly mounted to the rear wall 22 of the housing 12 and projects outwardly from the outer surface of the rear wall 22. A second handle 34 is pivotably mounted to the side walls 18, 20 of the housing 12 of the device 10 at pivot points 36, 38.

The second handle 34 comprises first arm 40, second arm 42 and connecting portion 44 extending between and connecting the first 40 and second arms 42. The arms 40, 42 and bridging portion 44 collectively define a substantially U-shaped handle 34.

The first arm includes a flange portion 48 connecting first arm 40 to side wall 20 of the housing 12 of the ash removing device 10. Second arm 42 of the second handle 34 includes a flange portion 50 connecting second arm 42 to the side wall 18 of the housing 12 of the ash removing device 10. The flange portion 48 provides a clearance between first arm 40 of second handle 34 and the outer surface of the side wall 20 of the housing 12. The flange portion 50 provides a clearance between second arm 42 of second handle 34 and the outer surface of the side wall 18 of the housing 12. The first 40 and second 42 arms of second handle 34 have a length sufficient to extend beyond the outer surface of the front door 24 and rear wall 22 of the housing 12 of the ash removing device 10. The length of the arms 40, 42 are long enough to provide a clearance between connecting portion 44 of second handle 34 and the rear wall 22 or front door 24, depending on the position of the second handle 34.

Still referring to FIG. 4, the housing 12 of the device 10 is shown in the closed position with the terminal end portions of arms 40, 42 and connecting portion 44 extending beyond the front door 24 of the housing 12. Because the front edge of bottom wall 16 of the housing 12 extends beyond the front edge of the top wall 14 of the housing, and the edges of the side walls 16, 18 of the housing 12 are sloped, the front door 24 of the housing slopes at an angle from the top wall 14 to the bottom wall 16 of the housing 12.

Figure 5:
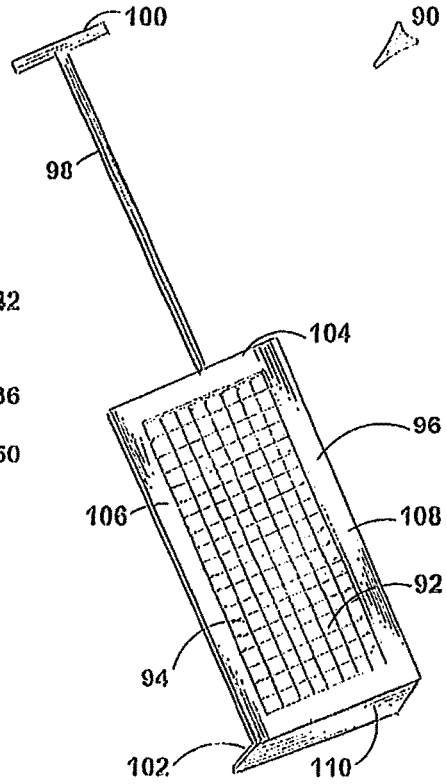
FIG. 5 shows an illustrative embodiment of a sifting tool used for reclaiming hot ashes.

FIG. 5 shows the sifting tool of the kit. Sifting tool 90 includes grid or screen 92 having a plurality of openings 94. Screen 92 is bordered on all four sides by a frame 96 used to manipulate the ashes into a pile for sifting. Frame 96 of the tool 90 is connected to an elongated handle 98. Handle 98 terminates into gripping portion 100. Frame 96 includes a leading edge 102, trailing edge 104, and side edges 106, 108. A hoe-like portion 110 depends downwardly from the leading edge 102 of the frame 96 and extends between the side edges 106, 108 of the frame 96 to push or pull the ashes and debris into a pile for sifting.

Figure 6:
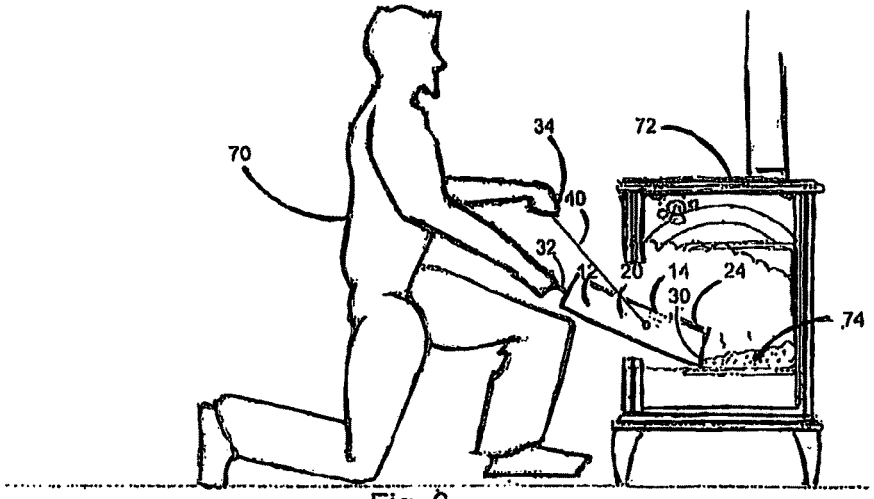
FIG. 6 shows the illustrative embodiment of the ash removing device of FIGS. 1-4 in use removing ashes from a wood burning stove.

FIG. 6 shows a side view of ash removing device 10 in use. FIG. 6 illustrates the ash removing device 10 with the front door 24 of the housing 12 in the open position and resting on the outer surface of the top wall 14 of the housing 12. In the open position, the lower edge of the front door 24 points in a direction rearwardly in relation to the housing 12. The user 70 is shown gripping and lifting the first fixedly mounted handle 32 projecting outwardly from the rear wall 22 of the housing 12 with one hand. The user is shown gripping the second pivotably mounted handle 34 with the other hand and the handle 34 is held in a position that is projecting upwardly and rearwardly from the housing 12. Using handles 32 and 34, the user 70 inserts the front portion of the housing 12 of the device 10 into the interior of a wood burning stove 72 containing a quantity of hot ashes and debris 74. The housing 12 is advanced further into the interior of the stove 72 until a desired quantity of ashes and debris 74 are contained by the housing 12. Once the desired quantity of ashes and debris 74 are collected in the housing 12, the user 70 draws the housing 12 from the stove 72 using handles 32, 34. As the housing 12 is drawn from the stove 72, the pivotably mounted handle 34 pivots toward the front portion of the housing 12. The user releases handle 34 and closes the front door 24 of the housing 12. The closing of the front door 24 against the sloped edges of the side walls 18, 20 and bottom wall 16 of the housing 12 results in the hot ashes 74 being captured within the inner volume 26 of the housing 12. Once the door 24 has been closed, the user grabs handle 34 moves it further forward toward the front of the housing 12. The rear 22 of the housing 12 drops toward the ground as the housing 12 rotates about an imaginary axis extending between pivot points 36, 38. The rotation about the imaginary axis extending between pivot points 36, 38, results in the closing of the front door 24 against the sloped edges of the side walls 18, 20 and bottom wall 16 of the housing 12. The hot ashes 74 are now captured within the inner volume 26 of the housing 12.

Figure 7:
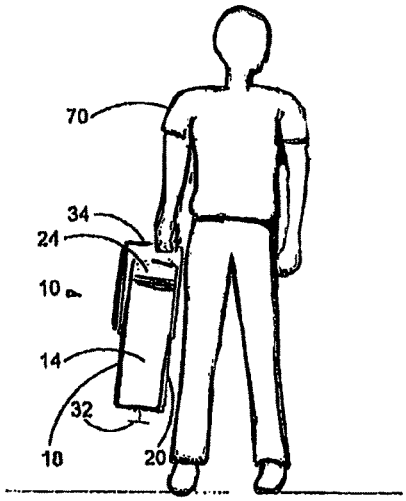
FIG. 7 shows the illustrative embodiment of the ash removing device of FIGS. 1-4 in transport position containing a quantity of used ashes.

Now referring to FIG. 7, the user 70 is shown standing in an upright position holding the ash removing device 10 the user's right side. The user is holding the device 10 by the bridging portion 44 of the pivotably mounted handle 34. The device 10 is held with its longitudinal axis L substantially perpendicular to the floor. Front door 24 of the housing is facing upwardly and resting against the side walls 18, 20 and bottom wall 14 of the housing 12. The rear wall 22 of the housing 12 is facing downwardly toward the floor. In view of the fact that the front door 24 is resting against the side walls 18, 20 and bottom wall 16 of the housing 12, there is no chance that the collected hot ashes can escape from the housing 12.

Figure 8:
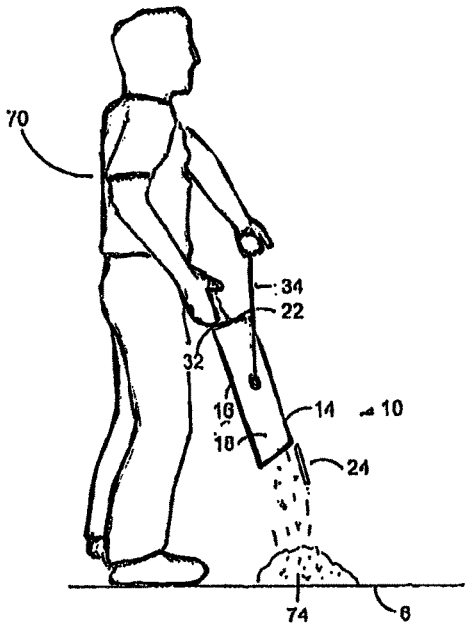
FIG. 8 shows the illustrative embodiment of the ash removing device being emptied of a quantity of used ashes.

Turning now to FIG. 8, user 70 is shown emptying a quantity of ashes and debris 74 that were collected from wood burning stove 72 (shown in FIG. 6) at desired container or location 80 remote from the wood burning stove 72. To remove ashes 74 from the device housing 12, holding second handle 34 in one hand, the user 70 grips first handle 32 with the other hand. The rear wall 22 of the housing 12 is rotated upwardly, thereby causing the front wall 24 to rotate downwardly toward the ground G and to open. Once the front wall 24 opens, the ashes and debris 74 exit the housing 12 of the device 10 via the force of gravity and are deposited at the desired location 80.

While the ash removing device has been described above in connection with certain illustrative embodiments, it is to be understood that other similar embodiments may be used or modifications and additions may be made to the described embodiments for performing the same function without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the ash removing device should not be limited to any single embodiment, but rather construed in breadth and scope in accordance with the recitations of the attached claims.

The invention claimed is:

1. An ash remover comprising:

an elongated housing comprising top and bottom walls, a rear wall, a front opening opposite said rear wall, side walls extending from said front opening to said rear wall, a front door, a long axis extending from said front opening to said rear wall and being parallel to said side walls, and a short axis extending between said side walls and being perpendicular to said side walls;

a first handle fixedly mounted rearwardly from said rear wall of said housing; and a second handle pivotably mounted outwardly from side walls of said housing and having a length sufficient and is configured to pivotably extend frontwardly beyond said front door, through a neutral position that is perpendicular to said top and bottom walls of said elongated housing, and rearwardly beyond said rear wall of said elongated housing.

2. The ash remover of claim 1, wherein said U-shaped handle comprises a substantially gripping portion.

3. The ash remover of claim 1 wherein said front door is movably attached to said top wall of said housing.

4. The ash remover of claim 3 wherein said front door is hingedly attached to said top wall of said housing by a hinge member.

5. The ash remover of claim 1 wherein said housing comprises a closure member mounted on said bottom wall of said housing.

6. The ash remover of claim 1 wherein said housing comprises a closure member mounted on said front door of said housing.

7. The ash remover of claim 1 wherein said first fixedly mounted handle is substantially T-shaped.

8. The ash remover of claim 1 wherein said second pivotably mounted handle is substantially U-shaped.

9. The ash remover of claim 8, wherein said substantially U-shaped second handle comprises first and second arms and a connecting portion extending between and connecting said first and second arms, said second handle pivotably mounted outwardly from side walls of said housing with a clearance between said first and second arms and said side walls of said housing, and said second handle having and a length sufficient to extend frontwardly beyond said front door and rearwardly beyond said rear wall of said housing.

10. A kit comprising a sifting tool and an ash remover, wherein said sifting tool comprises a screen having a plurality of openings and a plurality of sides, wherein said screen is bordered on all of said sides in a same plane by a frame, said frame comprising a leading edge, a trailing edge and side edges, a hoe portion depending downwardly from said leading edge of said frame, extending between said side edges of said frame and configured to pull ashes, and an elongated handle attached to said trailing edge of said frame, and wherein said ash remover comprises an elongated housing comprising top and bottom walls, side walls, a rear wall, a front opening opposite said rear wall, and a front door; a first handle fixedly mounted outwardly from a rear wall of said elongated housing; and a second handle pivotably mounted outwardly from side walls of said housing and having a length sufficient to extend frontwardly beyond said front door and rearwardly beyond rear wall of said elongated housing.

11. The kit of claim 10, wherein said elongated housing comprises a top wall having a front edge, a bottom wall having a front edge that extends beyond said front edge of said top wall, side walls having sloped front edges that slope from said front edge of said top wall to said front edge of said bottom wall, a rear wall, and an opening; a first handle fixedly mounted outwardly from said rear wall of said elongated housing; and a substantially U-shaped second handle comprising first and second arms and a connecting portion extending between and connecting said first and second arms, said second handle pivotably mounted outwardly from side walls of said elongated housing with a clearance between said first and second arms and said side walls of said elongated housing, and said second handle having a length sufficient and is configured to pivotably extend frontwardly beyond said front door through a neutral position that is perpendicular to said top and bottom walls of said elongated housing, and rearwardly beyond said rear wall of said elongated housing.

12. The kit of claim 11, wherein a front door is movably attached to said top wall of said housing.

13. The kit of claim 12, wherein said front door is hingedly attached to said top wall of said housing by a hinge member.

14. The kit of claim 13, wherein said housing comprises a closure member mounted on said bottom wall of said housing.

15. The kit of claim 13, wherein said housing comprises a closure member mounted on said front door of said housing.

16. The kit of claim 10, wherein said first fixedly mounted handle is substantially T-shaped.

17. An ash remover comprising:

an elongated housing comprising a top wall having a front edge, a bottom wall having a front edge that extends beyond said front edge of said top wall, side walls having sloped front edges that slope from said front edge of said top wall to said front edge of said bottom wall, a rear wall, a front door and front opening opposite said rear wall, wherein said elongated housing further comprises a long axis extending from said front opening to said rear wall and being parallel to said side walls, and a short axis extending from said side walls and being perpendicular to said side walls;

a first handle fixedly mounted rearwardly from said rear wall of said elongated housing; and a substantially U-shaped second handle comprising first and second arms and a connecting portion extending between and connecting said first and second arms, said second handle pivotably mounted outwardly from side walls of said elongated housing with a clearance between said first and second arms and said side walls of said elongated housing, and said second handle having and a length sufficient and is configured to pivotably extend frontwardly beyond said front opening, through a neutral position that is perpendicular to said top and bottom walls of said elongated housing, and rearwardly beyond said rear wall of said elongated housing.

18. The ash remover of claim 17, wherein said front door is movably attached to said top wall of said elongated housing.

19. The ash remover of claim 18, wherein said front door is hingedly attached to said top wall of said elongated housing.

20. The ash remover of claim 19, comprising a closure member mounted on said bottom wall of said elongated housing.

21. The ash remover of claim 19, comprising a closure member mounted on said front door of said elongated housing.

22. The ash remover of claim 17, wherein said first fixedly mounted handle is substantially T-shaped.

* * * * *